United States Patent [19]

Zitser et al.

[11] 4,452,295

[45] Jun. 5, 1984

[54] APPARATUS FOR PRODUCTION OF CORES FROM FLUIDIZED SANDS IN HOT BOXES

[75] Inventors: Vitaly A. Zitser, Dolgoprudny, Moskovskaya; Alexandr V. Melnikov, Moscow; Leonid V. Bachelis; Igor I. Dreishev, both of Moscow; Eduard G. Shartner, Karaganda; Vladimir D. Abaskalov; Vladimir A. Levinson, both of Karaganda; Nikolai K. Shishkin, Moscow; Vladimir A. Ivanov; Jury E. Morozov, both of Moscow, all of U.S.S.R.

[73] Assignee: Tsentralnoe Proektnokonstruktorskoe I Tekhnologicheskoe Bjuro Glavsantekhprom, U.S.S.R.

[21] Appl. No.: 264,183

[22] Filed: May 15, 1981

[30] Foreign Application Priority Data

May 16, 1980 [SU] U.S.S.R. ..... 2917101

[51] Int. Cl.[3] ..... B22C 11/04

[52] U.S. Cl. ..... 164/186; 164/213; 164/228; 164/341

[58] Field of Search ..... 164/341, 186, 213, 339, 164/340, 228

[56] References Cited

U.S. PATENT DOCUMENTS

| | | | |
|---|---|---|---|
| 3,802,484 | 4/1974 | Ovodov et al. | 164/169 |
| 4,083,396 | 4/1978 | Michelson | 164/186 X |
| 4,103,734 | 8/1978 | Mikotin et al. | 164/341 X |
| 4,184,533 | 1/1980 | Breitbarth | 164/186 X |

FOREIGN PATENT DOCUMENTS

| | | | |
|---|---|---|---|
| 201786 | 1/1959 | Austria | 164/186 |
| 2057318A | 4/1981 | United Kingdom . | |
| 351632 | 11/1972 | U.S.S.R. | 164/213 |

*Primary Examiner*—Nicholas P. Godici
*Assistant Examiner*—J. Reed Batten, Jr.
*Attorney, Agent, or Firm*—Steinberg & Raskin

[57] ABSTRACT

An apparatus for the production of cores from fluidized sands in hot boxes comprises individual mechanisms for joining and disjoining top and bottom sections of core boxes, which are placed beyond the confines of the latter. The joining mechanism incorporates at least two spring-loaded grapples mounted on individual shafts, fitted in satellites and positioned on a transport device, so as to carry core boxes. Located at one end of each grapple is a wedging member which co-operates with a wedging member provided on the top section of each core box. The disjoining mechanism includes stops, positioned on a support frame, and rollers mounted on the other end of each grapple for interaction with the stops.

2 Claims, 3 Drawing Figures

APPARATUS FOR PRODUCTION OF CORES FROM FLUIDIZED SANDS IN HOT BOXES

BACKGROUND OF THE INVENTION (1) Field of application

The present invention relates to core-making machines, and more particularly, to an apparatus for the production of cores from fluidized sands in hot boxes.

The machine of the invention may be used at mass-production plants of, for example, the sanitary engineering industry, automobile industry, electrical engineering and machine-building industries.

Core-making processes based on hot-box and cold-box techniques are in wide use today. However, the equipment employed for performing these techniques fail to provide satisfactory solution to the problems of enhancing production efficiency, increasing the strength of a sand mixture, and improving working conditions. The reason for this is ineffective ventillation of cores, especially such that are used in heating boilers and radiators and enclosed in metal, having, with the exception of two small core print holes, no contact with a mould. Since the hardening of a sand takes place uniformly throughout the cross section, the cores are made up of two pieces, which are subsequently glued together, whereby a vent is provided inside the core to communicate the latter with the atmosphere. Needless to say that additional technological operations render the core-making process much more complicated, labour- and time-consuming, as well as impossible for adaptation to automatic performance. In addition, dimensional accuracy of the cores thus produced is impaired along with their quality.

(2) Description of the prior art

There is known a simple method of making cores, which consists in that a fluidized sand is packed under pressure in a hot core box, which then is sealed, and the sand is held therein for a preset time required for the sand to harden, whereupon the box is opened and a finished core is removed therefrom (cf. U.S. Pat. No. 3,802,484, cl. 164–169).

The above method is suitable for the production of any type of cores made in a single piece, since natural vents or porosity are formed in the interior of each core to permit effective ventillation of gases.

There is known an apparatus for making cores in accordance with the prior-art method, also described in the patent referred to above.

The apparatus in question comprises vessels and feeders for metering initial sand components, a mixer with a gate adapted to close its outlet, an injection cylinder with a plunger, a proportioning chamber, a slide with a telescopic piston, and a lifting platform. The apparatus is operated in the following manner.

Initial components of a sand mixture are fed to a mixer to be properly intermixed therein. The fluidized sand thus prepared is then passed through the outlet into the proportional chamber which is closed from the bottom by the slide. Once the proportioning chamber is filled, the gate closes the mixer outlet, the slide is actuated to bring the nozzle in alignment with the proportioning chamber, and the lifting table is operable to raise the hot core box, forcing it against the nozzle. Under the action of the injection cylinder, the plunger performs compacting of the sand in the core box. On completion of the packing operation, the core box is sealed to thereby prevent the sand from being forcibly discharged through the outlet of the core box. After a period of time required for the foam to settle and for the sand to loose its flowability, the core box is transferred onto another station. The slide is again actuated to close the proportioning chamber from the bottom and the sand leftovers are removed therefrom. The plunger is lifted to occupy its initial position, and the gate is actuated to open the mixer outlet. The operating cycle is then resumed.

Under certain conditions, pressure is increased in the core box to reach a value sufficient to overcome the weight of the top section of each core box. If, however, the core box is not held joined together for an appropriate time at the packing station on completion of packing and sealing, then its top section will be raised to permit the discharging of sand to take place at its parting, which will inevitably lead to the production of a defective core.

On the other hand, an extensively long period of time, during which the core box is held between the lifting table and the packing device so as to ensure a drop in pressure preventing the uplifting of the core box section on completion of the disjoining operation, adversely affects production efficiency of the core-making machine and, in the final count, fails to completely eliminate vertical vibrations of the core box top section due to occur under the effect of residual pressure. The result of such vibrations is impaired dimensional accuracy and, consequently, poor quality of the core being produced.

There is known an apparatus for making cores from fluidized sands in hot boxes, which comprises a support frame mounting a transport means and, arranged in the direction of the technological process, a device for the preparation of a fluidized sand, an appliance for packing the sand in core boxes whose top and bottom sections are joined and disjoined by appropriate mechanisms, a device for separation of core boxes, and an arrangement for the delivery of finished cores (see, for example, patent application No. 2,057,318 laid out with the Patent Office of Great Britain on Apr. 1, 1981, the inventors of which are partially the same as of the present application).

The above-mentioned apparatus comprises a heating chamber mounted on the support frame between the packing mechanism and the core separating device, and a pusher operable to move the core boxes through the heating chamber.

The device for separation of core boxes includes a mechanism for punching the cores in the core boxes, and the transport means made in the form of a floor conveyer co-operating with the packing mechanism via a transfer table and with the core-box separating device via a second transfer table.

In the apparatus described above the mechanisms for joining and disjoining top and bottom sections of each core box are built in the core boxes and are actuated by individual drives which are arranged before the heating chamber and behind it, if viewed in the direction of the technological process.

The actuator of the core-box joining mechanism is made in the form of an air cylinder. The core-box disjoining mechanism is connected with brackets having adjustable stops.

The core-box joining and disjoining mechanisms incorporate two horizontal bars with tapered members which are positioned in its lower part and interact with the drives, and two vertical bars fixed on its upper part and each having one of its ends formed with slits and tapered holes permitting co-operation with the tapered members of the horizontal bars.

The above-described apparatus is operated as follows.

The first transfer table is actuated to lift a hot box from the transport means and delivers it to the sand packing device. One of the drives is operable to act on the horizontal bars, positioned in its lower part, so that the tapered members are received in the tapered holes provided in the vertical bars which are disposed in its upper part. In this way the top and bottom sections of a core box are reliably joined together. This operation renders it unnecessary to hold the core boxes at the after-packing station and thus makes it possible to substantially reduce the operating cycle of the apparatus.

The packing mechanism is operable to compact the sand in the core box, which is first sealed and then delivered by the pusher to the heating chamber. As the next core box is brought to the heating chamber, the preceding box is brought out of the latter to be thereafter handled by the mechanism for delivering a finished core. The mechanism in question is operable to drag the core box onto the second transfer table. Towards the end of travelling, the horizontal bars of the core box, positioned in its lower part, are acted upon by another drive to be thereby returned to initial position. As a result, the top and bottom sections of the core box are brought apart and the core box is disjoined. The tapered members of the horizontal bars are brought out of the tapered holes in the vertical bars. As this happens, the core box is depressurized. The separation device is operable to open the core box, and the vertical bars positioned in the top section of the box are disengaged from the horizontal bars which are disposed in the bottom section of the core box. The operation of disengagement is carried out unhinderedly due to the provision of slits.

After a finished core has been removed from the core box, the latter is reassembled by means of the separating device and then is lowered by the second transfer table on to the conveyor means operable to return the core box to the packing station.

The fact that the core-box joining and disjoining mechanisms are built into the core box and, therefore, depend on its construction, render it oftentimes difficult, if not impossible, reliable joining and disjoining of the top and bottom sections of each core box.

In addition, the provision of drives co-operating with the core-box joining and disjoining mechanisms makes the apparatus complicated in construction and impair its operating reliability.

SUMMARY OF THE INVENTION

It is an object of the invention to provide an apparatus for making cores from fluidized sands in bot boxes, wherein it will be possible to ensure reliable joining and disjoining of the top and bottom sections of each core box.

Another object of the invention is to provide an apparatus for making cores from fluidized sands in hot boxes, which will be simple in construction.

Still another object of the invention is to improve operating reliability of a core-making apparatus.

These and other objects of the invention will be attained in an apparatus for the production of cores from a fluidized sand in hot boxes, comprising a support frame mounting a transport means and, arranged in the direction of the technological process, are a device for the preparation of a fluidized sand, an appliance for packing the sand in the core boxes whose top and bottom sections are joined and disjoined by respective joining and disjoining mechanisms, a device for separation of the core boxes, and an arrangement for the delivery of finished cores, according to the invention, satellites are provided to carry the core boxes and, positioned on the transport means at every station of the technological process, is the mechanism for joining the top section with the bottom section of each core box, including at least two spring-loaded grapples mounted on individual shafts, fitted in the satellites, and each having one of its ends carrying a wedging member interacting with a wedging member fixed on the top section of each core box, the mechanism for disjoining the bottom section of each core box having stops provided on the support frame, and rollers positioned on the other end of each grapple for interaction with the stops.

The stops provided on the support frame are preferably positioned in direct proximity with the device for separation of core boxes.

Such apparatus construction makes it possible to ensure reliable joining and disjoining of the top and bottom sections of core boxes, and therefore to substantially improve operating reliability of the apparatus as a whole.

BRIEF DESCRIPTION OF THE DRAWINGS

These and other objects of the invention will be further described, by way of example only, with reference to the accompanying drawings, wherein.

DETAILED DESCRIPTION OF THE PREFERRED EMBODIMENT

Figure 1:
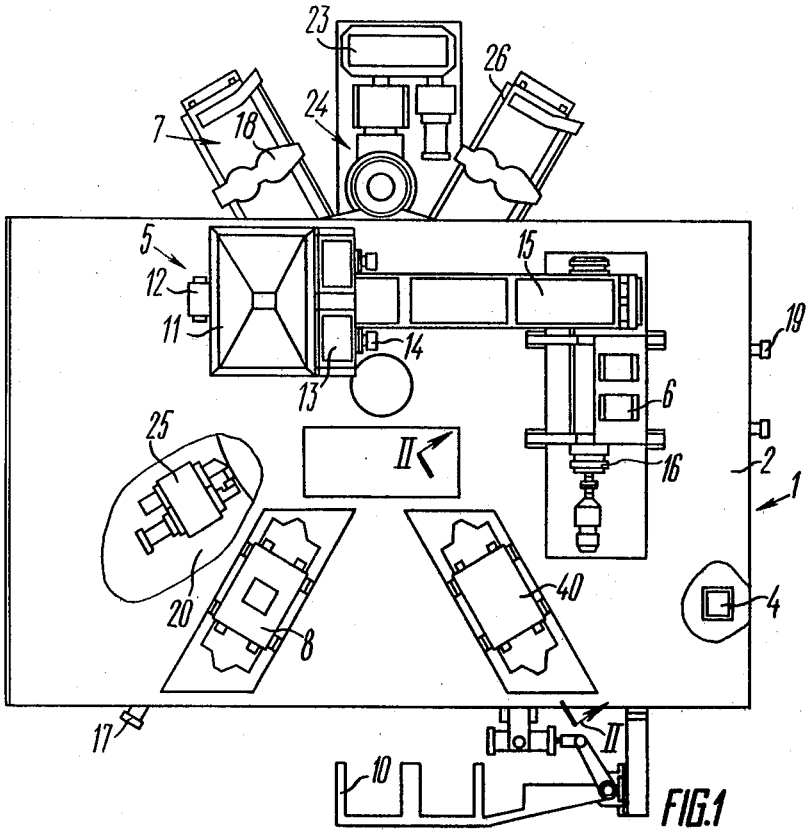
FIG. 1 is a plan view, with partial break-outs, of an apparatus for the production of cores from fluidized sands in hot boxes.
Figure 2:
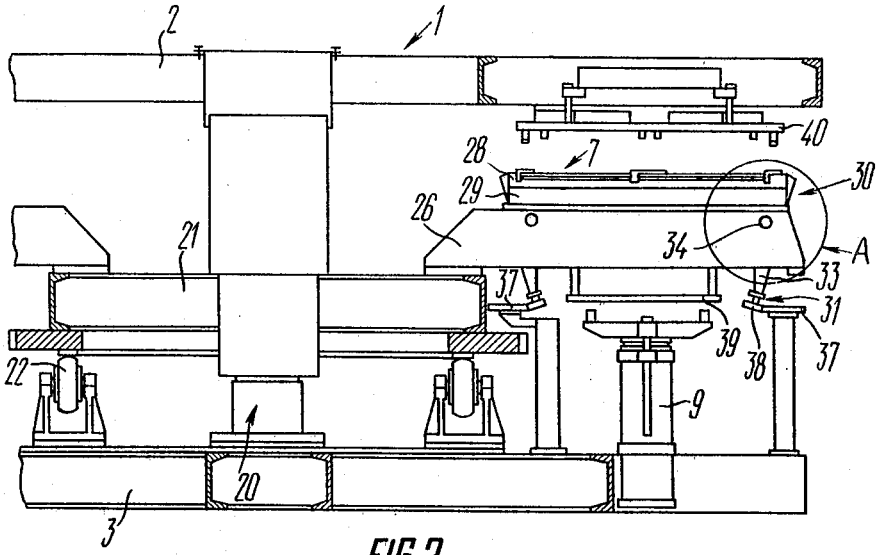
FIG. 2 is a cross section taken along line II—II of FIG. 1.

The apparatus illustrated comprises a support frame 1 (FIG. 1) made up of an upper part 2 (FIG. 2), a lower part 3 and columns 4 (FIG. 1) provided to connect these parts.

Mounted on the upper part 2 of the support frame 1 and, arranged in the direction of the technological process, are a device 5 for the preparation of a sand mixture, an appliance 6 for packing the sand in core boxes 7, a mechanism 8 for punching the cores in the core boxes 7, a device 9 (FIG. 2) for separation of the core boxes 7, and an arrangement 10 (FIG. 1) for the delivery of finished cores.

The device 5 for the preparation of a sand mixture comprises a hopper 11 for sand and feeders 12, tanks 13 for liquid components of the sand mixture with feeders 14, a mixer 15 and a distributor 16.

The apparatus incorporates a mechanism 17 for opening gates 18 of the core boxes 7, and a mechanism 19 for closing the gates 18 of the core boxes 7, which are mounted on the support frame 1. The gates 18 are provided to close the core print holes in the core boxes 7.

Mounted on the lower part 3 (FIG. 2) of the support frame 1 is a transport means 20 made in the form of a rotary-type platform having a body 21 movable relative to the lower part 3 of the support frame 1 over rollers 22 by a drive 23 (FIG. 1) coupled to the body 21 through a gear train 24. The body 21 of the revolving platform is held in position at every station of the technological process by a register 25 interacting with the body 21. Provided at every station of the technological process are satellites 26 (FIG. 2) adapted to carry the core boxes 7, positioned on the body 21 of the revolving platform.

Figure 3:
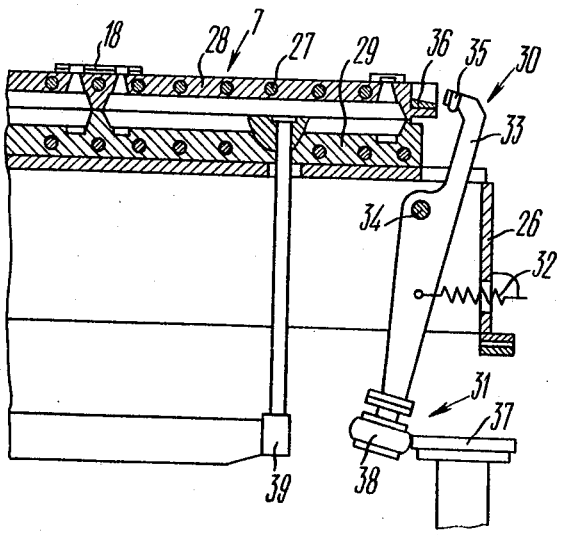
FIG. 3 is an enlarged view of section A in FIG. 2.

In the apparatus of the invention the core boxes 7 (FIG. 3) are heated by means of heating elements 27 which are respectively built into the top section 28 and the bottom section 29 of the core box 7.

The top section 28 and the bottom section 29 of each core box 7 are joined together by means of a mechanism 30 and brought apart by a mechanism 31.

The mechanism 30 for joining the top section 28 and the bottom section 29 of the core boxes 7 incorporates four grapples 33 which are loaded by means of springs 32 and are positioned at the corners of the satellites 26. The number of grapples can be chosen according to the shape and size of a core box and should not be less than two.

The grapples 33 are mounted on individual shafts 34 built into the satellites 26. Fitted on one end of each grapple 33 is a wedging member 35 which interacts with a wedging member 36 fixed on the top section 28 of each core box 7.

The mechanism 31 for disjoining the top section 28 from the bottom section 29 of each core box 7 includes shaped stops 37, corresponding in number to the spring-loaded grapples 33 (FIG. 2), which are positioned on the lower part 3 of the support frame 1 in direct proximity with the device 9 for separation of the core boxes 7, and rollers 38 (FIG. 3) mounted on the other end of each grapple 33 for interaction with the stops 37.

The disassembly of the core boxes 7 is carried out by means of a pusher mechanism 39.

In the preferred embodiment of the invention, the mechanism 8 (FIG. 1) for punching the cores is made independent from the device 9 for separating the core boxes 7; the removal of finished cores from the top section 28 (FIG. 2) of the core boxes 7 is carried out by means of an arrangement 40 positioned on the upper part 2 of the support frame 1.

The apparatus according to the invention operates as follows.

Sand and liquid components of the sand mixture are respectively fed from the hopper 11 (FIG. 1) and from the tanks 13 to the feeders 12 and 14, and thence to the mixer 15. From the mixer 15 the fluidized sand is delivered to the distributor 16 and thence to the appliance 6 for packing the sand. Before the fluidized sand is compacted in the hot core box 7, the grapples 33 of the joining mechanism 30 are actuated by the springs 32 to turn about the individual shafts 34 so that their wedging members 35 are brought in contact with the wedging members 36 which are fixed on the top section 28 of each core box 7, thereby ensuring reliable joining of the sections 28 and 29 of the core box 7.

After the sand has been packed into the core box 7 (FIG. 1), the mechanism 19 is actuated to close the gates 18 of the core box 7, whereupon the latter is removed from the packing station. After a given period of time required for the sand to harden in the core box 7, the mechanism 17 is operable to open the gates 18, whereupon the mechanism 8 is brought in action to perform punching of the cores in the box 7, thereby communicating the interior vents of the cores with the atmosphere.

Then, the transport means 20 (FIG. 2) is set in rotation to deliver the core box 7 to the separating device 9. Acting on the pusher mechanism 39, the separating device 9 is first effective to perform disassembly of the core box 7, in the course of which the top section 28 thereof is lifted with the cores, and then the arrangement 10 for the delivery of cores is brought along to be placed under the cores. During the second stroke of the separating device 9, the cores in the top section of the core box 7 are acted upon by the mechanism 40 for the removal of cores and are thus forced out onto the arrangement 10 (FIG. 1) for the delivery of cores, which brings them beyond the confinement of the apparatus. Blowing and spraying of the core boxes are carried out when required. Further on, the separating device 9 (FIG. 2) is brought down to its initial position, thereby performing assembly of the core box 7.

On the way from the punching station to the separating station, the rollers 38 (FIG. 3) of the disjoining mechanism 31 interact with its stops 37, as a result of which the springs 32 are expanded and the grapples 33, turning relative to the shafts 34, are brought apart to disjoin the top section 28 from the bottom section 29 of the core box 7, thereby preparing the latter for disassembly. Meantime, the wedging members 35 are disengaged from the wedging members 36. On the way from the separating station to the packing station, the rollers 38 are brought out of contact with the stops 37, the springs 32 are compressed and the grapples 33 are actuated to join the top section 28 with the bottom section 29 of the core box 7, thereby preparing the latter for the next packing operation.

The apparatus according to the invention for making cores from fluidized sands in hot boxes makes it possible to substantially expand production potentialities of such apparatus. It becomes feasible to employ core boxes of any construction and size, and to reduce the downtime of the apparatus by 20 to 25 percent.

For the sake of clarity, particular specific terminology is used but the invention is in no way limited by the terms so adopted and therefore it should be borne in mind that each such term covers all equivalent elements operating in a similar manner and employed for solving similar problems.

While the invention has been described herein in terms of the preferred embodiments, numerous variations may be in the apparatus illustrated in the drawings and herein described without departing from the invention as set forth in the appended claims.

What is claimed is:

1. An apparatus for the production of cores from fluidized sand in core boxes made up of a top section, at least two first wedging members fixed on said top section, a bottom section, gates adapted to close core print holes of these boxes, and a pushing mechanism, comprising:

a support frame;

a device arranged on said support frame for the preparation of a sand mixture;

an appliance arranged on said support frame for packing the sand mixture in said core box;

a device arranged on said support frame for separation of said core box;

an arrangement arranged on said support frame for the delivery of finished cores;

transport means mounted on said support frame;

satellites adapted to mount said core boxes and positioned on said transport means;

at least two individual shafts built in each one of said satellites;

at least one spring-loaded grapple mounted on each one of said shafts and having a first end and a second end;

at least one second wedging member mounted on the first end of each said grapple adapted to interact with a respective first wedging member of a respective core box;

said spring-loaded grapples and second wedging members mounted thereon constituting means for joining the top section with the bottom section of a respective core box;

stops positioned on said support frame;

rollers mounted on the second end of each said grapple for interaction with a stops;

said stops forming in combination with said rollers, a mechanism of disjoining said top and bottom sections of said core box.

2. An apparatus as claimed in claim 1, wherein said stops are arranged on said support frame in close proximity with said device for separation of said core boxes.

* * * * *